US007784778B2

(12) United States Patent
Shimizu et al.

(10) Patent No.: US 7,784,778 B2
(45) Date of Patent: Aug. 31, 2010

(54) STACKER, POST-FINISHING APPARATUS INCORPORATING THE STACKER, AND IMAGE FORMING SYSTEM CONNECTED TO THE POST-FINISHING APPARATUS

(75) Inventors: Satoru Shimizu, Hachioji (JP); Tsuyoshi Mizubata, Hachioji (JP); Tomohiko Kiryu, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 628 days.

(21) Appl. No.: 11/803,344

(22) Filed: May 14, 2007

(65) Prior Publication Data

US 2007/0296991 A1 Dec. 27, 2007

(30) Foreign Application Priority Data

Jun. 21, 2006 (JP) ..... 2006-171144
Mar. 12, 2007 (JP) ..... 2007-061608

(51) Int. Cl.
*B65H 37/04* (2006.01)

(52) U.S. Cl. ..... 270/58.12; 270/58.07; 270/58.08; 270/58.11; 270/58.17; 270/58.27

(58) Field of Classification Search ..... 270/58.07, 270/58.08, 58.09, 58.11, 58.12, 58.17, 58.27
See application file for complete search history.

(56) References Cited

U.S. PATENT DOCUMENTS

| | | | | |
|---|---|---|---|---|
| 6,382,616 | B1 * | 5/2002 | Waragai et al. | 270/58.12 |
| 7,392,983 | B2 * | 7/2008 | Kodama et al. | 271/249 |
| 2005/0230896 | A1 * | 10/2005 | Funada | 270/58.08 |
| 2006/0071410 | A1 * | 4/2006 | Koie | 271/207 |

FOREIGN PATENT DOCUMENTS

| | | |
|---|---|---|
| JP | 11-199121 | 7/1999 |

* cited by examiner

*Primary Examiner*—Gene Crawford
*Assistant Examiner*—Leslie A Nicholson, III
(74) *Attorney, Agent, or Firm*—Cantor Colburn LLP

(57) ABSTRACT

A stacker, including a sheet stacking section which receives sheets and stacks the sheets, a stopping member which stops the top edge of the sheet and aligns the sheet, plural paddle-wheels which press against the sheet and convey the sheet to the stopping member, and a control section which controls the paddle-wheels to shift perpendicular to the sheet conveyance direction, to be arranged on both side edges of the sheets, and to press against the both side edges of the sheets.

27 Claims, 5 Drawing Sheets

STACKER, POST-FINISHING APPARATUS INCORPORATING THE STACKER, AND IMAGE FORMING SYSTEM CONNECTED TO THE POST-FINISHING APPARATUS

This application is based on Japanese Patent Application Nos. 2006-171144 filed on Jun. 21, 2006, and 2007-061608 filed on Mar. 12, 2007, with the Japanese Patent Office, the entire content of which is hereby incorporated by reference.

TECHNICAL FIELD

The present invention relates to a stacker which aligns and accommodates plural sheets, a post-finishing apparatus which has the stacker to perform post-finishing operations, and an image forming system including an image forming apparatus, such as an electro-photographic copying machine, a printer, and a compound machine, which are connected to said post-finishing apparatus.

BACKGROUND OF THE INVENTION

In recent years, a post-finishing apparatus, which performs post-finishing operations, such as stitching, folding, and adhering processes, after sheets carrying formed images are aligned on a stacker, is connected to an image forming apparatus, such as an electro-photographic copying machine, a printer, a facsimile and a compound machine which compounds these, whereby an image forming system is structured. Due to this, the operator is saved the trouble of stitching the sheets, carrying the formed image by hand, and thereby the operator more efficiently conducts office duties.

In such post-finishing apparatus, after each sheet, which has curled during previous procedures, is placed on a sheet table, without alignment or at an angle, the post-finishing operations are conducted to the sheets. Therefore the sheets are not aligned, and their appearance is worse, which is a problem of overall quality.

In the conventional art, to overcome this problem, the sheets are struck against an alignment member which is placed perpendicular to the conveyance direction of the sheet, and further, manufacturing accuracy of conveyance members has been improved, thereby displacement and angled placement are corrected.

As an example which overcomes this problem, Unexamined Japanese Patent Application Publication No. 11-199,121 discloses a sheet processing apparatus in which plural drawing paddles are provided to adjust the tops of the sheets (see four positions shown in FIG. 6).

In the sheet processing apparatus of the above patent example, since the drawing paddles are fixed at predetermined positions, the various portions of the drawing paddles come into contact with the sides of various sheets, that is, the contacting portions depend upon the size of the sheet. Therefore, the effects of the paddle differ based on the size of sheet. Specifically, when both sides of the sheet are largely curled, the touched portions of the drawing paddles shift inside in the case of particular size of sheets. Accordingly, the curl, which is out of the touched portion of the drawing paddles, still exists, that is, though the alignment member is used, the sheets are stacked without being aligned, which does not overcome irregularity of the stacked sheets.

Further, the shape of the curled sheets differs, based on the type of sheets, which may be convex or concave curled. For example, the shape varies depending on whether it is a recycled sheet, a thin sheet, a thick sheet, a high quality sheet, a flipped sheet, and a sheet carrying a color-toner image.

SUMMARY OF THE INVENTION

The present invention has been realized to overcome the above problems, and an object of the present invention is to provide:

a stacker which aligns curled sheets and accommodates them, in which various bending of the sheets is corrected, a post-finishing apparatus including the above stacker, and an image forming system connecting the post-finishing apparatus.

According to one embodiment of the present invention, the stacker includes:

a sheet stacking section which receives the sheet and stacks the sheet, a stopping member which stops the top edge of sheet and aligns the sheet, plural paddle-wheels which press against the sheet and convey the sheet to the stopping member, and a control section which controls the paddle-wheels to shift perpendicular to the sheet conveyance direction, wherein the control section controls the paddle-wheels to be arranged on both side edges of the sheets, and controls to press against the both side edges of the sheets.

According to another embodiment of the present invention, a post-finishing apparatus includes:

a sheet stacking section which receives the sheets and stacks them, a stopping member which stops the top edge of sheet and align the sheets, plural paddle-wheels which press against the sheet and convey the sheet to the stopping member, a control section which controls the paddle-wheels to shift perpendicular to the sheet conveyance direction, and controls to change the disposition of the paddle-wheels, and a post-finishing section which conducts post-finishing operation on the plural sheets which have been aligned on the sheet stacking section, wherein the control section controls the paddle-wheels to be arranged on both side edges of the sheets, and to press against both side edges of the sheets.

According to yet another embodiment of the present invention, in an image forming system which includes an image forming apparatus which includes an image forming section which forms an image on an image conductor, a transfer section which transfers a toner image onto a sheet, and a fixing apparatus which fixes the transferred toner image, and a post-finishing apparatus which is connected to the image forming apparatus, wherein the image forming system is characterized in that the post-finishing apparatus includes:

a sheet stacking section which receives the sheets and stacks them, a stopping member which stops the top edge of sheet and align the sheets, plural paddle-wheels which press against the sheets and convey the sheet to the stopping member, a control section which controls the paddle-wheels to shift perpendicular to the sheet conveyance direction, and a post-finishing section which conducts post-finishing operation on the plural sheets which are aligned on the sheet stacking section, and wherein the control section controls the paddle-wheels to be arranged on both side edges of the sheets, and to press against both side edges of the sheets.

DETAILED DESCRIPTION OF THE PREFERRED EMBODIMENTS

Figure 1:
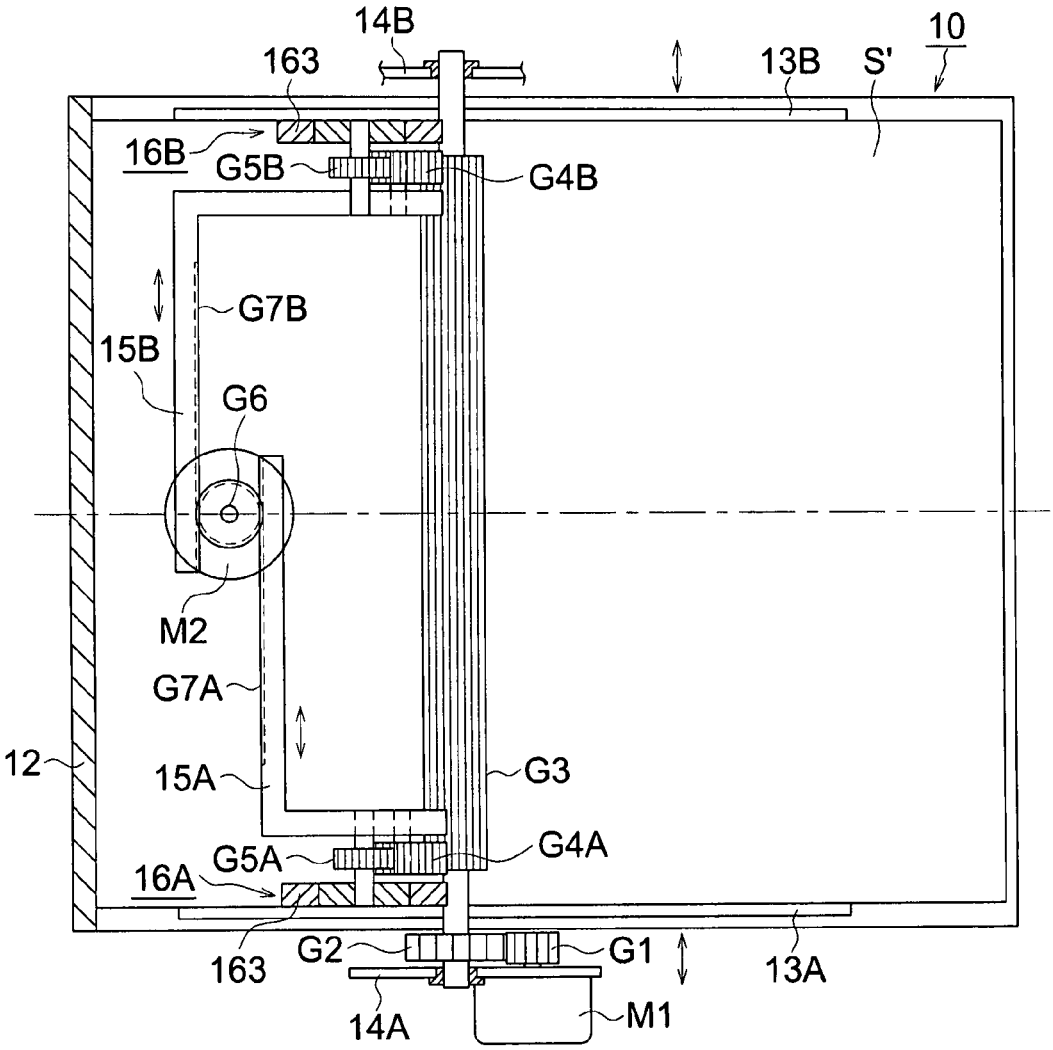
FIG. 1(*a*) is a plane view of a stacker, while FIG. 1(*b*) is a front view of the stacker.
Figure 1:
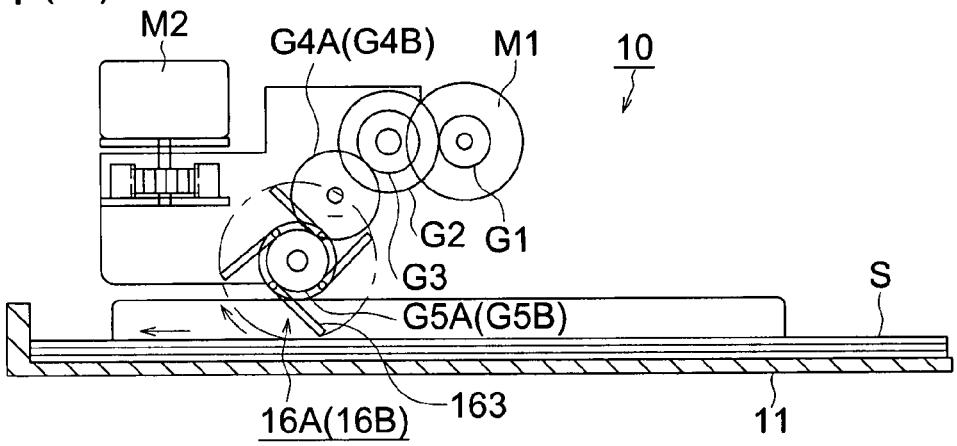

The embodiments of the present invention will now be detailed, while referring to the drawings.

[Stacker]

Figure 2:
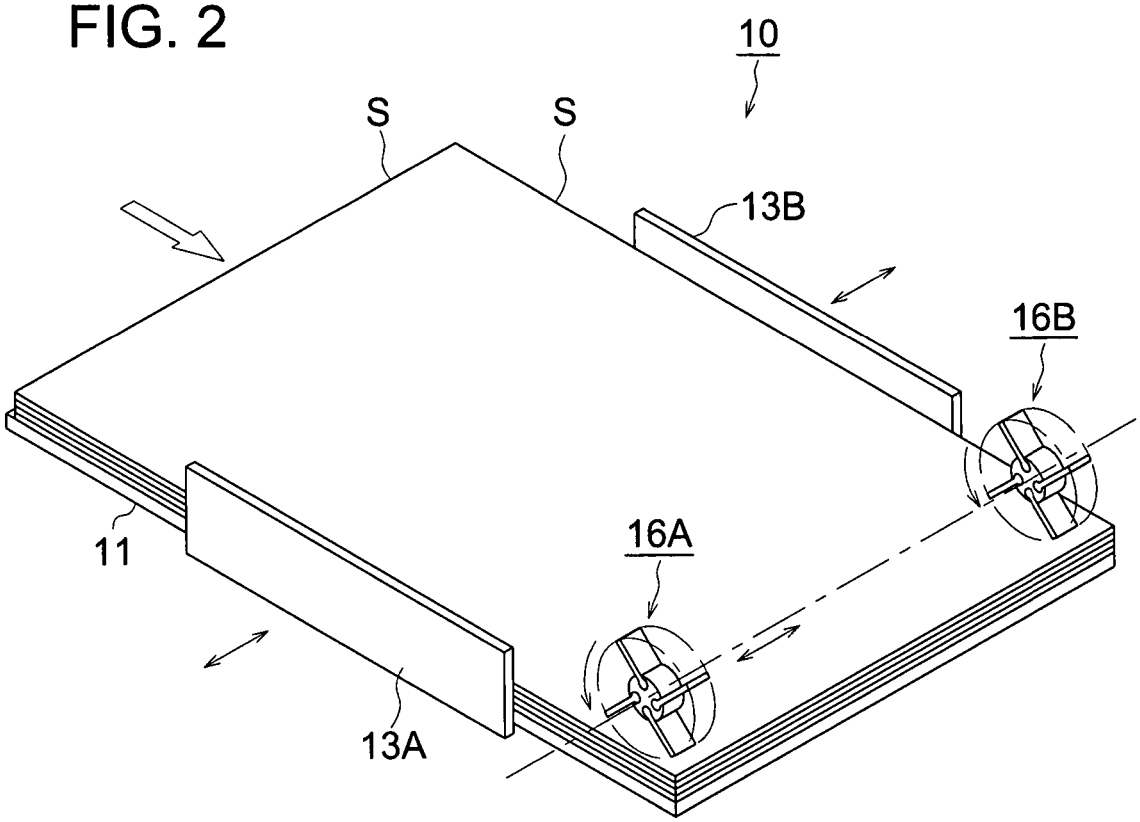
FIG. 2 is a perspective view of the stacker.

FIG. 1 (*a*) is a plane view of a stacker, while FIG. 1(*b*) is a front view of the stacker. FIG. 2 is a perspective view of the stacker.

Stacker 10 includes sheet stacking tray 11 which receives sheets S and stacks sheets S, stopping member 12 which stops the top edges of sheets S and align sheets S, alignment members 13A and 13B which align sheets S perpendicular to a sheet conveyance direction, paddle-wheels 16A and 16B, a paddle-wheel position shifting member, and a transmission member for the paddle-wheels.

[Transmission Member]

Motor M1, mounted on side plate 14A of stacker 10, rotates paddle-wheels 16A and 16B via the transmission member. The transmission member is structured of gears G1, G2, G3, G4A, G4B and G5A. Motor M1 rotates gear G3, which has long and straight teeth parallel to the rotation shaft, via gears G1 and G2. Both ends of the rotation shaft, extending from both ends of gear G3, are rotatably supported between side plate 14A and side plate 14B of stacker 10. That is, gear G3 is mounted perpendicular to the sheet conveyance direction.

Adjacent to both ends of gear G3, gear G4A and gear G4B are engaged, and movably supported in the direction of the rotation shaft of gear G3 by the position shifting member 15A, which will be detailed later. Gear G4A rotates gear G5A which is supported by position shifting member 15A, and rotates paddle-wheel 16A which is mounted on the same rotation shaft as gear G5A. Further, gear G4B rotates gear G5B which is supported by position shifting member 15B, and rotates paddle-wheel 16B which is mounted on the same rotation shaft as gear G5B.

Rotating paddle-wheels 16A and 16B come into contact with the front surface of sheet S which is to be conveyed onto sheet stacking tray 11, so that sheet S is conveyed and pushed against stopping member 12. Further rotating paddle-wheels 16A and 16B press the surface of curled sheet S to flatten it. Both sides of flattened sheet S are pressed by alignment members 13A and 13B, and sheets S are aligned perpendicular to the sheet conveyance direction.

In addition, since the height of stacked sheets S varies in accordance with the number of stacked sheets S, the height of paddle-wheels 16A and 16B varies by a driving device, which is not illustrated.

Figure 3:
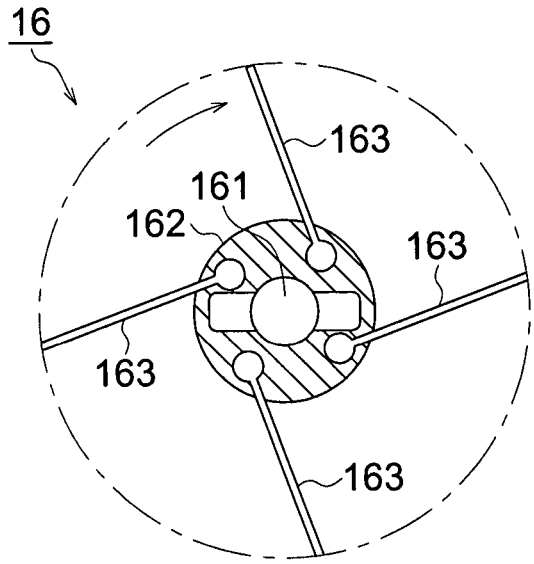
FIG. 3 is an enlarged cross-sectional view of a paddle-wheel.

FIG. 3 is an enlarged cross-sectional view of paddle-wheel 16. Paddle-wheels 16A and 16B are formed of the same shape, and are referred to as paddle-wheel 16.

Paddle-wheel 16 is structured of paddle shaft 161, supporting member 162 provided on paddle shaft 161, and blades 163 provided on supporting member 162.

As shown in FIG. 1, paddle shaft 161 is rotated by motor M1 via the transmission members. Plural blades 163 (being four blades in FIG. 3) are mounted on supporting member 162.

Blades 163 are formed of thin elastic plates, and for example, are made of resin plates such as polyurethane rubber, whose thickness is 1 mm.

As another example of paddle-wheel 16, paddle shaft 161, supporting member 162 and blades 163 can be integrally molded.

[Paddle-wheel Shifting Member]

As shown in FIG. 1, pinion gear G6, which is rotated by motor M1 mounted on stacker 10, engages rack G7A of position shifting member 15A, and geared rack G7B of position shifting member 15B. Position shifting member 15A having geared rack G7A, and position shifting member 15B having geared rack G7B are shifted in opposite directions to each other and perpendicular to the sheet conveyance direction by the rotation of pinion gear G6.

Since position shifting members 15A and 15B are moved in accordance with the sheet size of sheet S, the position of paddle-wheels 16A and 16B changes, whereby, even while rotating, paddle-wheels 16A and 16B press against both edges of sheet S, and curled sheets S is flattened.

Figure 4:
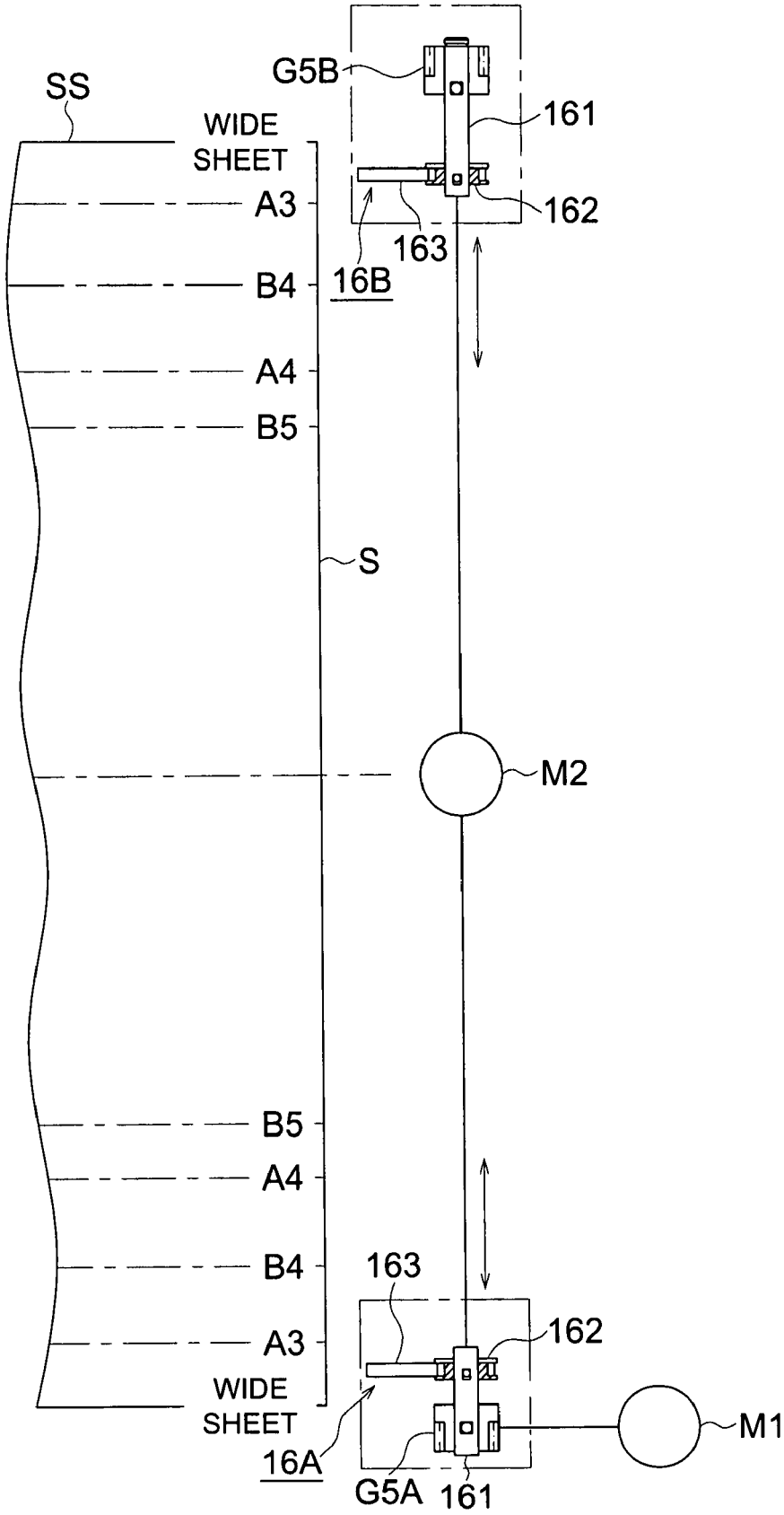
FIG. 4 is a plane view of the sizes of various sheets and the paddle-wheels.

FIG. 4 is a plane view of the sizes of various centered sheets S and paddle-wheels 16A and 16B.

Based on the size of sheet which is stacked in stacker 10, control section 100 shifts the position of paddle-wheels 16A and 16B in direction perpendicular to the sheet conveyance direction via position shifting members 15A and 15B, respectively, after which control section 100 allows rotating blades 163 to press against the surface of sheet S, and to flatten curled sheet S.

Figure 5:
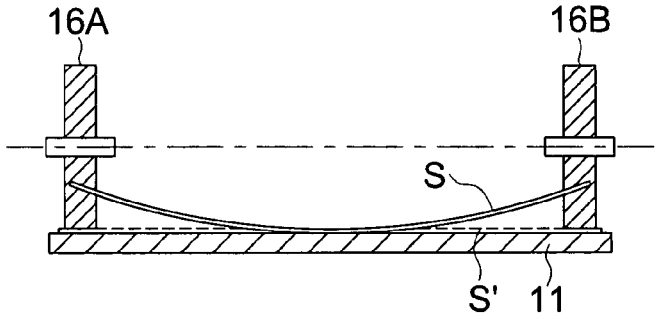
FIGS. 5(*a*) and 5(*b*) are cross-sectional views showing placement of the paddle-wheels.
Figure 5:
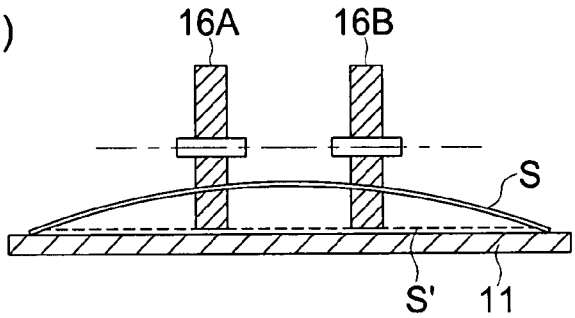

FIG. 5(*a*) is a cross-section, showing the positions of paddle-wheels 16A and 16B which flatten curling generated at the both edges of sheet S, while FIG. 5(*b*) is a cross-section, showing the positions of paddle-wheels 16A and 16B which flatten curling generated at the center of sheet S. Solid lined sheet S represents the curled sheet, while dash lined sheet S' represents the flattened sheet.

Figure 6:
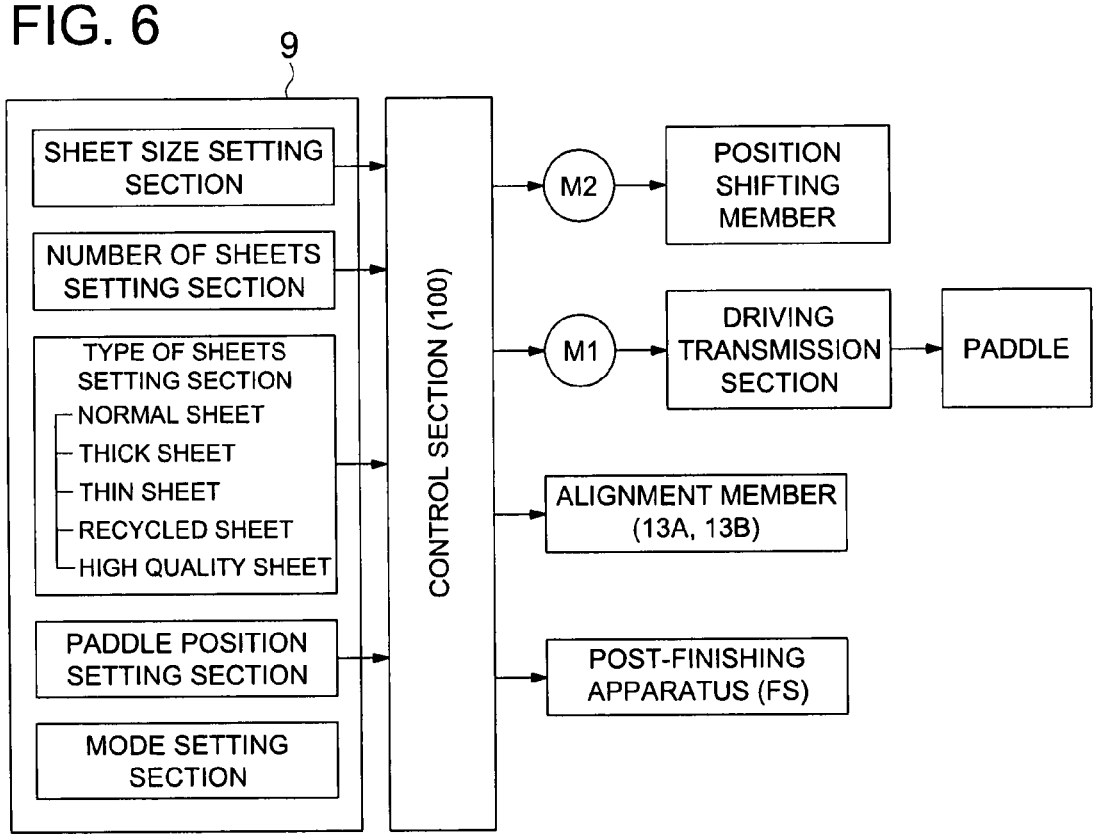
FIG. 6 is a block diagram which controls a transmission member, a position shifting member, and an alignment member.

FIG. 6 is a block diagram which shows control of paddle-wheels 16A and 16B, position shifting members 15A and 15B, and alignment members 13A and 13B. Based on setting information sent from operation section 9, control section 100 controls motor M2 to shift the positions of paddle-wheels 16A and 16B via position shifting members 15A and 15B. Further, control section 100 controls motor M1 to rotate paddle-wheels 16A and 16B via the transmission member. Still further, control member 100 controls alignment members 13A and 13B, and each section of post-finishing apparatus FS.

Figure 7:
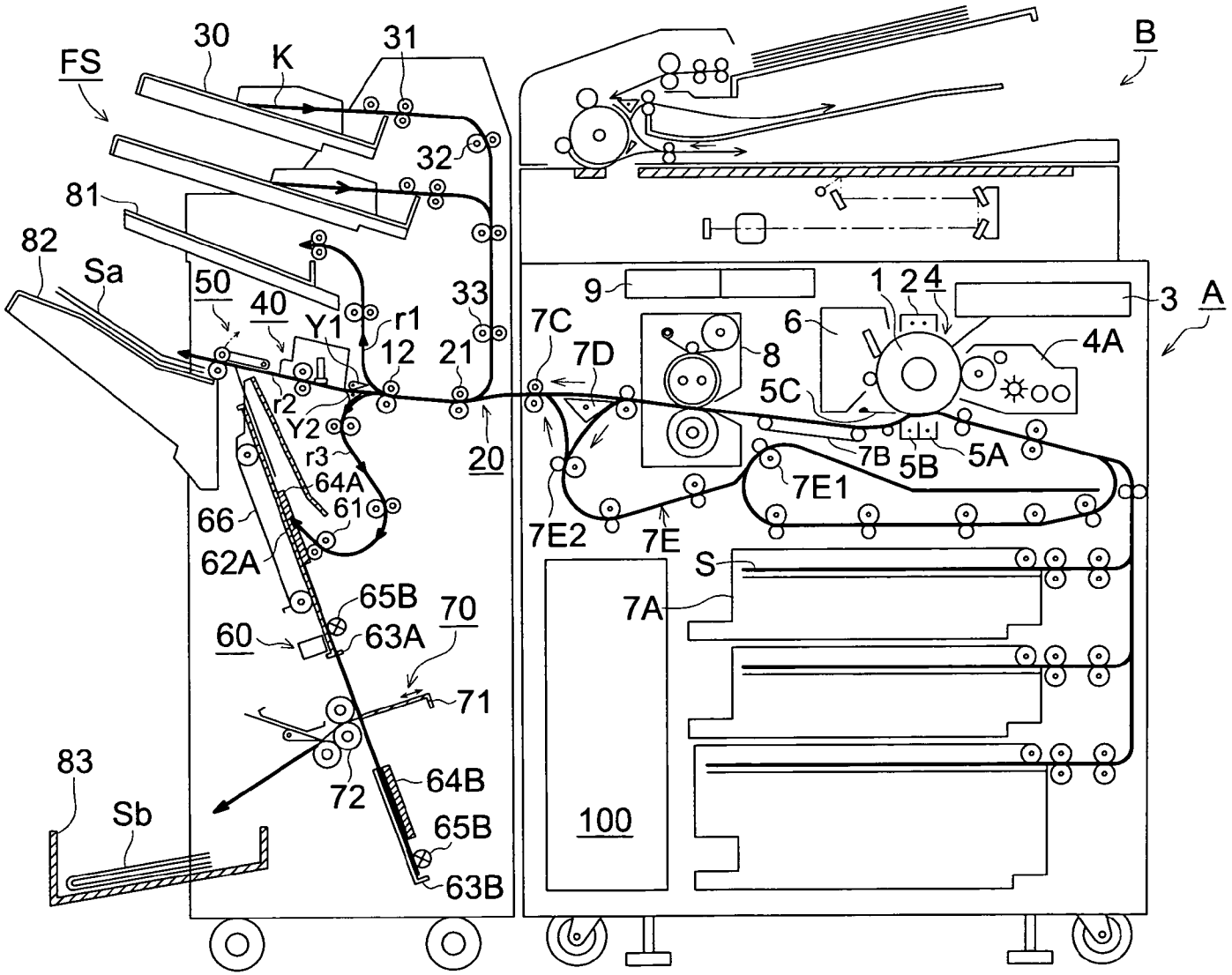
FIG. 7 is an overall schematic view of an image forming system structured of an image forming apparatus and a post-finishing apparatus.

In FIG. 7, at the front side of the top of image forming apparatus A, operation section 9 is provided via which various operating information is inputted. Operation section 9 includes setting sections of the sheet size, the number of sheets, the type of sheet, and the paddle-wheel position to be either the center or at both edges of the sheet. For the setting position of the type of sheet, a type of sheet is selected from among the various types of sheets, such as a normal sheet, a thick sheet, a thin sheet, a recycled sheet, and a high-quality sheet. Further a mode setting section is provided in which the image forming mode or the post-finishing mode is selected.

In addition, it is possible to provide control section 100 either on image forming apparatus A or post-finishing section FS.

[Image Forming System]

FIG. 7 is an overall schematic view of the image forming system including image forming apparatus A and post-finishing apparatus FS.

The structure of the image forming system will now be detailed while referring to FIG. 7. Since this is an example, if any image forming system includes the image forming apparatus and the post-finishing apparatus having any other features, and if the post-finishing operation to be described later is conducted on said post-finishing apparatus, said image forming system belongs to the category of the present invention.

Image forming apparatus A includes electro-charging device 2, image exposure device 3, developing device 4, transfer device 5A, electro-discharging member 5B, sheet separating member 5C, and cleaning device 6, each mounted around rotating image conductor 1. After the surface of image conductor 1 is electrically and evenly charged by electro-charging device 2, based on an image data which is read from the document via laser beams emitted from image exposure device 3, a latent image is generated via the exposure scan, which is developed in reverse via developing device 4, whereby a toner image is formed on the surface of image conductor 1.

Further, sheet S, supplied from sheet supply section 7A, is conveyed to a transfer position. The toner image is transferred, via transfer device 5A, onto sheet S at that transfer position. After sheet S is electrically discharged by discharging device 5B, sheet S is separated from image conductor 1 by sheet separating member 5C, and is conveyed by intermediate conveyance section 7*b*. the sheet carrying the transferred toner image is heated and fixed by fixing device 8, and is ejected from image forming apparatus A by paired sheet ejecting rollers 7C.

Any remaining toner on the surface of image conductor 1 is removed by cleaning device 6 downstream of separating crew 5C after image formation, and image conductor 1 waits for the next image formation cycle.

In case of double-sided image formation on sheet S, conveyance route switching plate 7D is switched, after the heat-fix by fixing device 8, sheet S is conveyed downward, and is switched back by paired flipping rollers 7E1, and is returned to the transfer position, where a new toner image is transferred onto the reverse side of sheet S. Next, sheet S, carrying the new toner image on the revere side, is heated and the image is fixed by fixing device 8. After sheet S, carrying the fixed image on the reverse, passes through conveyance switching plate 7D, said sheet S is ejected from image forming apparatus A by paired ejecting rollers 7C.

Still further, as will be described later, post-finishing processes, such as folding process or stitching process, are conducted, after conveyance route switching plate 7D is switched, sheet S, carrying the fixed image fixed by fixing device 8, is conveyed downward, and sheet S is switched back to be flipped by paired flipping rollers 7E2, after which said sheet S is ejected from image forming apparatus A by paired ejecting rollers 7C.

[Post-Finishing Apparatus]

Post-finishing apparatus FS, shown in FIG. 7, is provided with inlet conveyance section 20, sheet supply tray 30, sheet shifting section 40, sheet ejection section 50, sheet stitching device 60 and sheet folding device 70.

At the left of post-finishing apparatus FS shown in FIG. 7, provided are fixed sheet-ejection tray 81, elevating sheet ejection tray 82, capable of moving up and down while carrying shifted sheets S or side-stitched sheets Sa, and fixed sheet-ejection tray 83 which receives saddle-stitched sheets Sb.

Sheet S, ejected from paired ejecting rollers 7C of image forming apparatus A, is introduced to paired conveyance rollers 21 which are mounted near inlet conveyance section 20 of post-finishing apparatus FS. In addition, paired conveyance rollers 21 are positioned in close proximity to paired ejecting rollers 7C of image forming apparatus A.

Further, paired conveyance rollers 21 convey not only sheets S conveyed from image forming apparatus A, but also interleaving sheets K, such as cover sheets, or inserting sheets, conveyed from sheet supply tray 30. Interleaving sheets K are separately conveyed by sheet paired supply rollers 31, and sent to paired conveyance rollers 12 via paired conveyance rollers 32 and 33, as well as paired conveyance rollers 21. Hereinafter, interleaving sheet K is also generically referred to as sheet S.

Switching gates Y1 and Y2 are driven by solenoids, which are not illustrated, to select any one of three conveyance routes, which are first conveyance route r1 directing to fixed sheet-ejecting tray 81, second conveyance route r2 directing to sheet shifting section 40, and third conveyance route r3 directing to sheet stitching device 60.

When no post-finishing process is selected for sheet S, switching gates Y1 and Y2 are open only for first conveyance route r1, and cut off second and third conveyance routes r2 and r3. Sheet S is conveyed upward through first conveyance route r1, and stacked on fixed sheet-ejection tray 81.

Further, when the sheet shifting process is selected, switching gates Y1 and Y2 are open only for second conveyance route r2, and cut off first and third conveyance routes r1 and r3. Sheet S passes through second conveyance route r2, and is shifted perpendicular to the sheet conveyance direction by sheet shifting section 40. That is, sheet shifting section 40 changes the ejecting position of sheet S perpendicular to the sheet conveyance direction, for every predetermined number of sheets S. Shifted sheet S is ejected onto elevating sheet ejection tray 82, and stacked.

Still further, when either the sheet stitching process or the sheet folding process is selected, switching gates Y1 and Y2 are open only for third conveyance route r3, and cut off first and second conveyance routes r1 and r2. Sheet S passes through third conveyance route r3, and is stopped when the leading edge of sheet S comes into contact with paired registration rollers 61, whereby the leading edge of sheet S is aligned. After the trailing edge of sheet S is ejected from paired registration rollers 61, sheet S is released upward by inertial force along slanted sheet stacking section 62A. Next, sheet S goes down by its own weight, while slipping on the slope of slanted sheet stacking section 62A, and is stopped by stopping member 63A.

Near stopping member 63A, downstream of sheet stacking section 62A, a first stacker is provided, including paddle-wheel 65A, a position shifting member, and alignment member 64A, which together function to flatten and align curled sheet S.

When the predetermined number of sheets have been stacked on sheet stacking section 62A, the stacked sheets are aligned by paired stacking members 64A provided on both sides of sheet stacking section 62A, and sheets are stitched into booklet Sa at one or two positions by stitching device 60, whereby the stitching process is completed. Stitched booklet SA is conveyed upward by conveyance belt 66 on the slope of sheet stacking section 62A, and is ejected onto elevating sheet ejection tray 82.

Still further, when the saddle stitching-folding process is selected, stopping member 63A, to stop the side stitching sheets, is displaced from the conveyance route, and sheet S goes down by its own weight, while slipping on the slope of slanted sheet stacking section 62A, and is stopped by stopping member 63B to stop saddle stitching sheets, whereby sheet S is stacked on sheet stacking section 62B.

Near stopping member 63B, further downstream of sheet stacking section 62B, a second stacker is provided, including paddle-wheel 65B, a position shifting member, and alignment member 64B, which together function to flatten and align curled sheets S.

After sheets S are aligned, stitching pins are driven into the center of sheets S by sheet stitching device 60. Sheet folding device 70, which includes folding plate 71, plural folding rollers 72, folds saddle stitched booklet Sb at its center, and ejects said booklet Sb onto fixed sheet-ejection tray 83.

Based on the stacker, the post-finishing apparatus, and the image forming system of the present invention, the effects described below will be obtained.

1. The sheets are properly aligned, independent of the sheet size, the sheet type, and the amount of curl.

2. Sheets are properly aligned by the paddle-wheels of the stacker, whereby a booklet can be produced to the optimal style by the book binding operation, such as saddle stitching, side stitching or pasting.

3. Curls, generated on the various sheets in the fixing device of the image forming apparatus, are flattened by the paddle-wheels of the stacker of the post-finishing apparatus, whereby the sheets are properly aligned.

What is claimed is:

1. A stacker for use with a sheet, comprising:

a sheet stacking section which receives the sheet and stacks the sheet, a stopping member which stops a top edge of the sheet and aligns the sheet, paired paddle-wheels which are structured to separate from and approach each other perpendicular to a sheet conveyance direction to press against the sheet, and convey the sheet to the stopping member; and a control section structured to control the paired paddle-wheels to separate from each other perpendicular to the sheet conveyance direction so that the paired paddle-wheels are arranged on side areas of the sheet, and press against the side areas of the sheet;

wherein the control section is further structured to control the paired paddle-wheels to approach each other perpendicular to the sheet conveyance direction so that the paired paddle-wheels are arranged on a center area of the sheet, and press against the center area of the sheet.

2. The stacker of claim 1, wherein the control section controls the paired paddle-wheels to be arranged on both side areas of the sheet for each sheet size, based on a sheet size.

3. The stacker of claim 2, further comprising a paddle-wheel position setting section which sets positions of the paired paddle-wheels, wherein when the positions of the paired paddle-wheels have been set by the paddle-wheel position setting section, the control section controls the paired paddle-wheels to be arranged on the set positions, independent of the sheet size.

4. The stacker of claim 1, wherein the control section controls the paired paddle-wheels to be arranged on the both side areas of the sheet or the center area of the sheet, based on a sheet type.

5. The stacker of claim 4, wherein when the sheet type is selected for which the paired paddle-wheels have been conducted to be arranged on the both side areas of the sheet, the control section controls the paired paddle-wheels to be arranged on the both side areas of the sheet, without controlling the paired paddle-wheels to be arranged on the center of the sheet, based on the sheet type.

6. The stacker of claim 5, further comprising a paddle-wheel position setting section which sets positions of the paired paddle-wheels, wherein when the positions of the paired paddle-wheels have been set by the paddle-wheel position setting section, the control section controls the paired paddle-wheels to be arranged on the set positions, independent of the sheet type.

7. The stacker of claim 1, further comprising a paddle-wheel position setting section which sets positions of the paired paddle-wheels, wherein the control section controls the paired paddle-wheels to be arranged on the positions which are set by the paddle-wheel position setting section.

8. The stacker of claim 7, wherein when the positions of the paired paddle-wheels have been set by the paddle-wheel position setting section, the control section controls the paired paddle-wheels to be arranged on the set positions, independent of the sheet size and the sheet type.

9. The stacker of claim 1, further comprising an alignment member which moves perpendicular to the conveyance direction of the sheet to align the sheet.

10. A post-finishing apparatus for use with a sheet, comprising:

a sheet stacking section which receives the sheet and stacks the sheet;

a stopping member which stops the top edge of the sheet and aligns the sheet;

paired paddle-wheels which are structured to separate from and approach each other perpendicular to a sheet conveyance direction to press against the sheet, and convey the sheet to the stopping member; and a control section structured to control the paired paddle-wheels to separate from each other perpendicular to the sheet conveyance direction so that the paired paddle-wheels are arranged on side areas of the sheet, and press against the side areas of the sheet; and a post-finishing section which performs post-finishing on plural sheets aligned by the sheet stacking section;

wherein the control section is further structured to control the paired paddle-wheels to approach each other perpendicular to the sheet conveyance direction so that the paired paddle-wheels are arranged on a center area of the sheet, and press against the center area of the sheet.

11. The post-processing apparatus of claim 10, wherein the control section controls the paired paddle-wheels to be arranged on both side areas of the sheet for each sheet size, based on a sheet size.

12. The post-processing apparatus of claim 11, further comprising a paddle-wheel position setting section which sets positions of the paired paddle-wheels, wherein when the positions of the paired paddle-wheels have been set by the paddle-wheel position setting section, the control section controls the paired paddle-wheels to be arranged on the set position, independent of the sheet size.

13. The post-processing apparatus of claim 10, wherein the control section controls the paired paddle-wheels to be arranged on the both side areas of the sheet or the center area of the sheet, based on a sheet type.

14. The post-processing apparatus of claim 13, wherein when the sheet type is selected for which the paired paddle-wheels are on the both side areas of the sheet, the control section controls the paired paddle-wheels to be arranged on the both side areas of the sheet, without controlling the paired paddle-wheels to be arranged on the center of the sheet.

15. The post-processing apparatus of claim 14, further comprising a paddle-wheel position setting section which sets positions of the paired paddle-wheels, wherein when the positions of the paddle-wheels have been set by the paddle-wheel position setting section, the control section controls the paired paddle-wheels to be arranged on the set position, independent of the sheet type.

16. The post-processing apparatus of claim 10, further comprising a paddle-wheel position setting section which sets a position of the paired paddle-wheels, wherein the control section controls the paired paddle-wheels to be arranged on the position which is set by the paddle-wheel position setting section.

17. The post-processing apparatus of claim 16, wherein when the positions of the paired paddle-wheels have been set by the paddle-wheel position setting section, the control section controls the paired paddle-wheels to be arranged on the set position, independent of the sheet size and the sheet type.

18. The post-processing apparatus of claim 10, further comprising an alignment member which moves perpendicular to the conveyance direction of the sheet to align the sheet.

19. An image forming system for use with a sheet, comprising:

an image forming apparatus comprising:

an image forming section which forms an image on an image conductor;

a transfer section which transfers a toner image onto the sheet; and a fixing apparatus which fixes the transferred toner image; and a post-finishing apparatus, connected to the image forming apparatus, comprising:

a sheet stacking section which receives the sheet and stacks the sheet, a stopping member which stops the top edge of the sheet and align the sheet, paired paddle-wheels which are structured to separate from and approach each other perpendicular to a sheet conveyance direction to press against the sheet, and convey the sheet to the stopping member; and a control section structured to control the paired paddle-wheels to separate from each other perpendicular to the sheet conveyance direction so that the paired paddle-wheels are arranged on side areas of the sheet, and press against the side areas of the sheet; and a post-finishing section which conducts post-finishing operation on plural sheets which are aligned on the sheet stacking section;

wherein the control section is further structured to control the paired paddle-wheels to approach each other perpendicular to the sheet conveyance direction so that the paired paddle-wheels are arranged on a center area of the sheet, and press against the center area of the sheet.

20. The post-finishing system of claim 19, wherein the control section controls the paired paddle-wheels to be arranged on both side areas of the sheet for each sheet size, based on a sheet size.

21. The post-processing system of claim 20, further comprising a paddle-wheel position setting section which sets positions of the paddle-wheels, wherein when the positions of the paired paddle-wheels have been set by the paddle-wheel position setting section, the control section controls the paired paddle-wheels to be arranged on the set position, independent of the sheet size.

22. The post-processing system of claim 19, wherein the control section controls the paired paddle-wheels to be arranged on the both side areas of the sheet or the center of the sheet, based on a sheet type.

23. The post-processing system of claim 22, wherein when the sheet type is selected for which the paired paddle-wheels are on the both side areas of the sheet, the control section controls the paired paddle-wheels to be arranged on the both side areas of the sheet, without controlling the paired paddle-wheels to be arranged on the center area of the sheet.

24. The post-processing system of claim 23, further comprising a paddle-wheel position setting section which sets positions of the paired paddle-wheels, wherein when the positions of the paired paddle-wheels have been set by the paddle-wheel position setting section, the control section controls the paired paddle-wheels to be arranged on the set position, independent of the sheet type.

25. The post-processing system of claim 19, further comprising a paddle-wheel position setting section which sets positions of the paired paddle-wheels, wherein the control section controls the paired paddle-wheels to be arranged on the positions which are set by the paddle-wheel position setting section.

26. The post-processing system of claim 25, wherein when the positions of the paired paddle-wheels have been set by the paddle-wheel position setting section, the control section controls the paired paddle-wheels to be arranged on the set position, independent of the sheet size and the sheet type.

27. The post-processing system of claim 19, further comprising an alignment member which moves perpendicular to the conveyance direction of the sheet to align the sheet.

* * * * *